United States Patent [19]

Stoneman

[11] 4,158,276

[45] Jun. 19, 1979

[54] MULTIPLE PASSAGE ROOF FLASHING ASSEMBLY

[76] Inventor: Harold R. Stoneman, 617 S. Isis Ave., Inglewood, Calif. 90301

[21] Appl. No.: 839,281

[22] Filed: Oct. 4, 1977

[51] Int. Cl.[2] ..... C04D 13/14

[52] U.S. Cl. ..... 52/219; 98/60

[58] Field of Search ..... 52/58, 60, 218, 219; 285/117, 137, 331; 16/2; 98/60

[56] References Cited

U.S. PATENT DOCUMENTS

| | | | |
|---|---|---|---|
| 278,723 | 6/1883 | Monteath | 285/177 |
| 1,684,582 | 9/1928 | Hoagland | 285/177 |
| 1,686,881 | 10/1928 | Stephenson | 285/137 R |
| 3,170,607 | 2/1965 | Anthon | 285/137 R |
| 3,582,096 | 6/1971 | Norton | 285/137 R |
| 3,696,242 | 10/1972 | Patry | 285/177 |
| 3,945,163 | 3/1976 | Nagler | 52/219 |
| 3,977,137 | 8/1976 | Patry | 52/58 |

*Primary Examiner*—Price C. Faw, Jr.
*Assistant Examiner*—H. E. Raduazo
*Attorney, Agent, or Firm*—Ben E. Lofstedt

[57] ABSTRACT

A roof flashing and counter-flashing assembly for providing a fluid-sealing passageway for pipes, tubes and conduits through the roof of a building including a sleeve anchorable at one open end to the roof about the roof opening through which the pipe, tube or conduit passes, a roof flashing member having a sleeve portion slideably mateable about the other sleeve and a radially-extending flange portion about the one end of the sleeve portion positioned immediately over the anchorable portion of the sleeve, a cap to sealingly cover the unanchored open end of the sleeve and having an opening therethrough through which the pipe, tube or conduit will pass and a pair of receptacles therein, an annular seal disposed between the cap and the sleeve and the cap and the roof flashing member, a double sealing washer slideably mateable about the pipe, tube or conduit and adapted to seat about the opening in the cap, a retainer clamp having an aperture therein to fit freely over the pipe, tube or conduit and a pair of additional openings therein to accommodate a pair of fasteners, a pair of fasteners adapted to pass through the pair of openings in the clamp and mateable with the pair of receptacles in the cap to secure the clamp to the cap and to effect fluid sealing engagement between the double sealing washer and the opening in the cap and about the pipe, tube or conduit, and means to removably secure the cap to the sleeve.

27 Claims, 10 Drawing Figures

MULTIPLE PASSAGE ROOF FLASHING ASSEMBLY

BACKGROUND OF THE INVENTION

1. Field of the Invention

The present invention relates to roof flashing assemblies for accomodating the passage of various pipes, tubes and utility conduits, such as electrical, air venting, and water piping, through the roof of a building in a weatherproof fashion, and, more particularly, to a multiple passage roof flashing and counterflashing assembly.

2. Description of the Prior Art

Various methods and techniques have been employed in the prior art to bring various pipes, tubes, and utility conduits through the roofs of building for either venting to the atmosphere or for connection to the particular utility service in a trouble-free, leakproof fashion.

One major problem associated with the prior art is the need to reduce the number of roof openings. The prior art is typically characterized by the use of roof flashing assemblies which permit but one pipe, tube or conduit through such assembly. By reducing the number of roof openings, not only is the likelihood of roof leakage reduced when it rains, but the number of roof flashing assemblies is correspondingly reduced as well. Such a reduction in the number of roof flashing assemblies effectuates a significant cost savings in the erection of the building structure.

Another problem frequently encountered in the prior art is the installation of additional pipes and conduits after the building structure has been erected and the roof finished. In such a case, one or more additional openings had to be made in the roof, an additional roof flashing assembly installed and the piping or conduit passed therethrough. Such retrofit modifications or additions are not only costly, but are time-consuming as well. Nevertheless, such after-the-fact installations occur with great frequency, and, are lamentably expected by both the builder and the owner.

The problem of electrolysis and its deleterious effects upon utility conduits and, especially plumbing piping, is well-known in the prior art. Metal-to-metal contact of different metals must be avoided if the familar metallic ion migration from one metal to the other is to be avoided. Such electrolysis is found to exist in the prior art roof flashing assemblies.

SUMMARY OF THE INVENTION AND OBJECTS

The present invention is generally described as a roof flashing and counter-flashing assembly for providing a leakproof passageway for pipes, tubes and conduits through the roof of a building including a sleeve anchorable at one open end to the roof about the roof opening through which the pipe, tube or conduit passes, a roof flashing member having a sleeve portion slideably mateable about the other sleeve and a radially-extending flange portion about one end of the sleeve portion to be positioned over the anchorable portion of the sleeve, a cap to cover the opposite end of the sleeve portion of the roof flashing member having a tapered opening therethrough through which the pipe, tube or conduit will pass and a pair of threaded receptacles therein, a double sealing washer slideably mateable about the pipe, tube or conduit and adapted to seat about the opening in the cap, a retainer clamp having an aperture therein to fit freely over the pipe, tube or conduit and a pair of additional openings therein to accomodate a pair of threaded fasteners, a pair of threaded fasteners adapted to pass through the pair of openings in the clamp and threadably mateable with the pair of threaded receptacles in the cap to move the clamp towards the cap to urge the double sealing washer into fluid sealing engagement with the opening in the cap and about the pipe, tube or conduit.

It is accordingly an object of the present invention to reduce the number of roof openings in a roof to accomodate various piping, tubing and utility conduits which must pass therethrough to either vent to the atmosphere or to be operatively coupled to the appropriate utility.

Another important object of the instant invention is to measureably reduce the probability of roof leakage during and/or following rain, sleet or from melting snow.

It is yet another primary and important object of the present invention to assure a completely sealed roof opening capable of total water immersion without water leakage into the space below the roof.

A still further and important object of the invention disclosed herein is to provide a convenient and low-cost means for permiting the interchangeability of pipes, tubes, and conduits following the original installation by merely replacing the original double sealing washer with one of the appropriate aperture size and shape.

It is an object of the present invention to provide a roof flashing assembly which permits the addition or deletion of pipes, tubes or conduits through the use of blind washers covering or opening other openings in the roof flashing assembly.

Another important feature and object of the invention is to provide the roof flashing assembly with the flexibility required for the installation of any combination of pipes, tubes or conduits through a single roof opening.

One feature of the invention is to provide for the accomodation of expansion and contraction of individual pipes, tubes, or conduits passing therethrough and of the roof structure proper.

The subject matter which I regard as my invention is particularly pointed out and distinctly claimed in the concluding portion of the Specification. The invention itself, however, both as to its organization and method of operation, together with further objects and advantages thereof, may be better understood by reference to the following description taken in connection with the accompanying drawings.

DESCRIPTION OF THE PREFERRED EMBODIMENT

Figure 1:
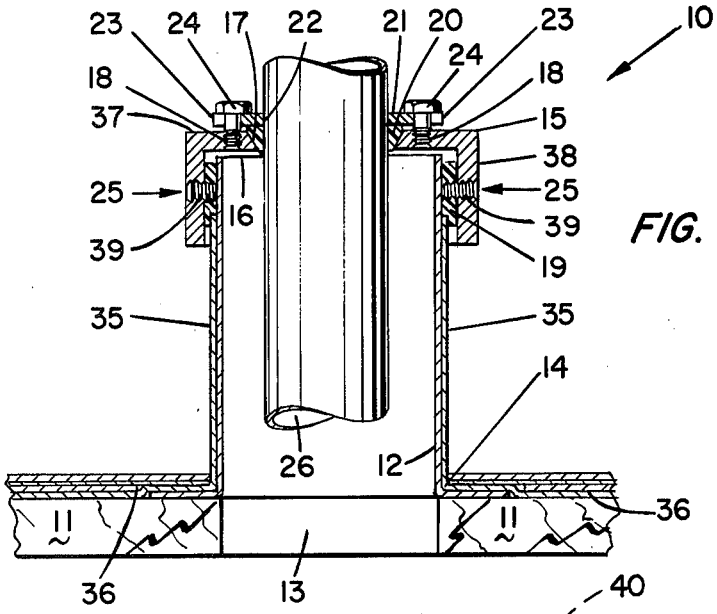
FIG. 1 is a side elevational view of the present invention taken along Plane 1—1 of FIG. 2.

With continued reference now to the Drawings, and, in particular now to FIG. 1, the present invention is basically shown and illustrated and indicated generally at 10. The present invention is descriptively identified as a roof flashing and counter-flashing assembly 10 which provides a leakproof passageway for one or more pipes, tubes or conduits through the roof 11 of a building.

The basic invention 10 comprises a sleeve 12 for mounting about the roof opening 13, a roof flashing member 14 slideably mateable over the sleeve 12, a cap 15 for covering the open end 16 of the sleeve 12 and having an opening 17 therethrough through which the pipe, tube or conduit 26 will pass and a pair of receptacles 18 therein, an annular seal 19 for effectuating a fluid seal between the cap 15 and the sleeve 12 and the cap 15 and the roof flashing member 14, a double sealing washer 20 about the pipe, tube or conduit 26 and seated about the rim of the cap opening 17, a retainer clamp 21 having an aperture 22 therein to fit freely over the pipe, tube or conduit 26 and a pair of additional openings 23 therein, a pair of fasteners 24 adapted to pass through the pair of openings 23 in the clamp 21 and secureably mateable with the pair of receptacles 18 in the cap 15 to secure the clamp 21 to the cap 15 and to effect fluid sealing engagement between the double sealing washer 20 and the opening 17 in the cap 15 and about the pipe, tube or conduit 26, and fastening means 25 to removably secure the cap 15 to the sleeve 12.

Figure 2:
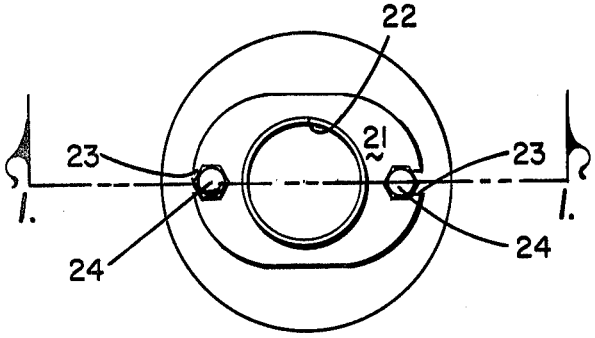
FIG. 2 is a top view of the instant invention as shown in FIG. 1.

The sleeve 12, while depicted in FIGS. 1 and 2 as a round or cylindrically shaped sleeve, may be, as desired, square or rectangularly shaped as illustrated in the other Figures herein. Additionally, the material of which the sleeve 12 is constructed may be metal or plastic. For example, the sleeve 12 may be formed, as appropriate for the specific application, of black steel tube and sheet, galvanized steel tube and sheet, copper tube and sheet, copper alloy tube and sheet, aluminum tube and sheet, stainless tube and sheet, plastic tube and sheet and fiberglas.

Figure 5:
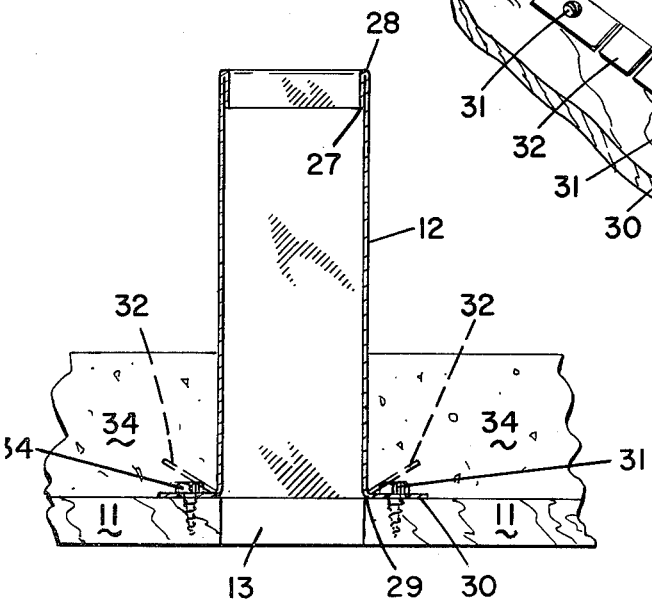
FIG. 5 is a side elevational view of the sleeve portion of the present invention taken along Plane 5—5 of FIG. 6.

With specific reference now to FIGS. 5, 6, 7 and 8, the sleeve 12 is illustrated in its rectangular shape. The upper end of the sleeve 12 is formed by folding the edge 27 one hundred and eighty degrees back against the body of the sleeve 12 to form an open end 16 with a re-inforced rim 28 which is stronger and stiffer. The desireability of this re-inforcement of the rim 28 of the sleeve 12 will become obvious as the description continues hereinafterwards. The opposite end 29 of the sleeve 12 has its edges folded outwardly to form lugs 30. Apertures 33 in the lugs 30 permit fasteners, such as nails or screws 31, to securely anchor the lugs 30 to the roof 11 about the opening 13. The sleeve 12 is also conveniently provided with tabs 32 which are bent further towards the body of the sleeve 12 than the lugs 30 when the sleeve 12 is to be anchored in concrete, as depicted in FIG. 5, to improve the anchoring of the sleeve 12 in the concrete 34.

The roof flashing member 14 includes a sleeve portion 35 and an outwardly-extending, flange-like portion 36. The sleeve portion 35 is conformable and slideably mateable with the sleeve 12. The flange-like portion 36 extends over the lugs 30 and the tabs 32 of the sleeve 12 and substantially therebeyond, the use and purpose of which will become known as the description of the invention continues herein. The roof flashing member 14 may be formed from the same basic materials used in forming sleeve 12.

Figure 4:
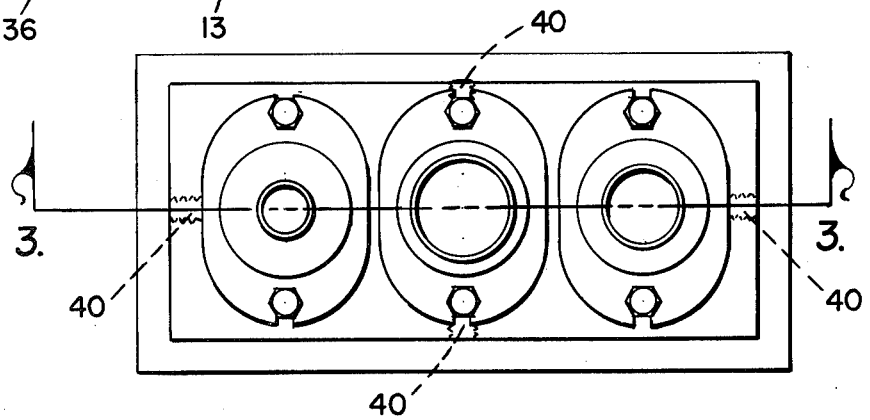
FIG. 4 is a top view of the invention as shown in multiple array form in FIG. 3.

The cap 15 includes a top portion 37 with a skirt portion 38 depending therefrom. An opening 17 is provided in the top portion 37 of the cap 15 through which the pipe, tube or conduit 26 passes. Additionally, a pair of receptacles 18 are also formed in the top portion 37 of the cap 15 for anchoring fasteners, such as the threaded bolts 24 and the like. Typically, the pair of receptacles 18 are arranged on either side of the opening 17 and are oppositely-disposed to each other. The opening 17 is tapered inwardly along the thickness of the material forming the top portion 37 of the cap 15. The opening 17 forms a seat for the double sealing washer 20 and the taper is necessary to assist in the effectuation of a double seal as described hereinafterwards. A plurality of threaded apertures 39 are arranged about the skirt portion 38 to permit set screws 40, such as Allen head type set screws, to be threadably mated therewith so that the ends thereof may be frictionally engaged with the sleeve 12 to fixedly anchor the skirt portion 38, and, therefor, the entire cap 15 to the sleeve 12. The ends of the set screws 40 are aligned so that the ends thereof engage the sleeve about the re-inforced rim 28 of the sleeve 12. Hence, as the set screws 40 are adjustably engaged with the sleeve 12, the re-inforcement of the rim 28 acts to resist deformation of the sleeve 12 which is constructed of sheet material as hereinbefore mentioned. Typically, at least two set screws 40 are used and the set screws 40 are oppositely disposed with respect to one another. When using a rectangularly shaped sleeve 12, a set screw 40 is used for each of the four sides of the skirt portion 38 as clearly shown in FIG. 4 of the Drawings, and arranged in opposition to the set screw on the matching parallel side of the rectangle.

It should be noted at this time that for purposes of nomenclature, the skirt portion 38 is oftentimes referred to as "counter-flashing" because the bottom edge of the skirt portion 38 overlaps the upper portion of the sleeve portion 35 of the roof flashing member 14. This overlap is necessary to effect a proper fluid seal in that it forms a cover to prevent rain from entering inbetween the top of the sleeve 12 and the sleeve portion 35 of the roof flashing member 14, and prevent leakage through the roof.

Arranged in sandwich fashion between the skirt portion 38 of the cap 15 and the sleeve 12 and the upper portion of the sleeve portion 35 of the roof flashing member 14 is an annular seal 19 for effectuating a fluid seal between the skirt portion 38 and the sleeve 12 and the skirt portion 38 and the sleeve portion 35 of the roof flashing member 14. Preferrably, the annular seal 19 is formed of a non-hardening waterproof compound, such as Stoneman Permaseal Waterproofing compound, which is composed of a base of non-hardening, non-drying synthetic resinous elastomer, with an asbestos filler, either No. 1591 or 1592. This annular seal 19 prevents standing water, that is, water which has accumulated on the roof 11, from entering via the underside of the cap 15, the opening 16 in the sleeve 12 and thereby flow through the roof 11 via opening 13.

A double sealing washer 20 is typically selected having a fixed outer diameter which is tapered to conformably mate with the tapered opening 17 to effect a fluid sealing relationship therebetween when urged thereinto as hereinafter described. The single, centrally located aperture of the washer 20 is sized to conformably and slideably mate about the exterior of the pipe, tube or conduit 26. Consequently, to accomodate various diameters of pipe, tube or conduit, one merely selects the appropriate washer 20 to fit thereabout; the balance of the roof flashing and counter-flashing assembly 10 remains unchanged while accomodating various sizes of pipe, tube or conduit.

A washer retainer clamp 21 having a centrally arranged aperture 22 therein is sized to freely pass over the various sized pipe, tube or conduit 26. A pair of apertures or slots 23 oppositely-disposed and arranged on either side of the centrally arranged aperture 22 are used for the passage of a pair of fasteners 24 therethrough for subsequent mating with the receptacles 18 in the cap 15. By adjusting the fasteners 24, the clamp 21 may be moved towards the washer 20 to urge the washer 20 into fluid sealing engagement with the tapered opening 17 in the cap 15. Thereafterwards, as the washer 20 is further urged against the opening 17 in the cap 15, the subsequent compressional effect thereof causes the washer 20 to expand radially and to thereby engage the pipe, tube or conduit 26 in fluid sealing relationship. Hence, since the net effect is to effectuate a fluid seal between the washer 20 and the pipe, tube or conduit 26 and the washer 20 and the opening 17 in the cap 15, the washer 20 is correctly described as a "double sealing" washer. All of the above is clearly and comprehensively shown and illustrated in FIG. 3 of the drawings.

It should be understood, at this time, that the foregoing description is that of a preferred embodiment of the present invention. Various changes and modifications will readily occur to those skilled in the art to which this invention pertains without departing from the spirit and scope of the invention, the breadth and extent of which is to be defined by the claims appended hereto.

Figure 10:
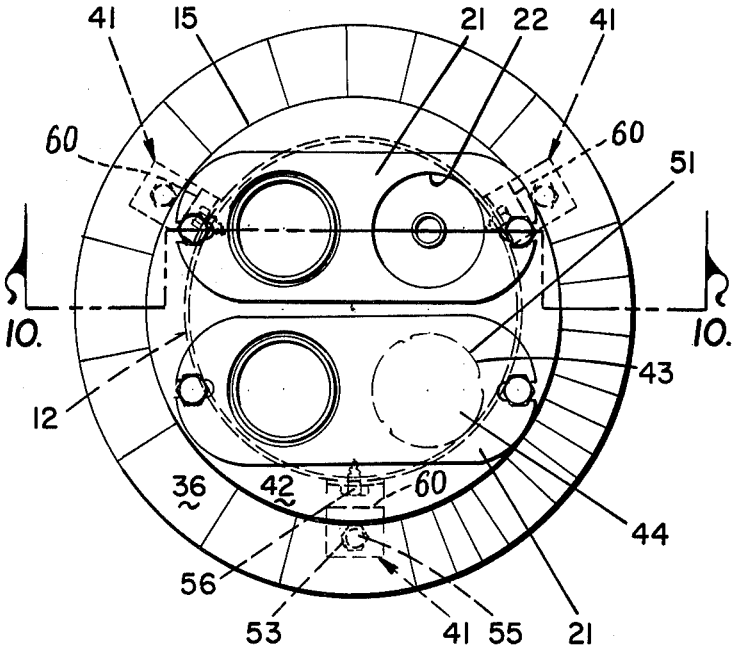
FIG. 10 is a top view of the embodiment of the present invention as shown in FIG. 9.
Figure 9:
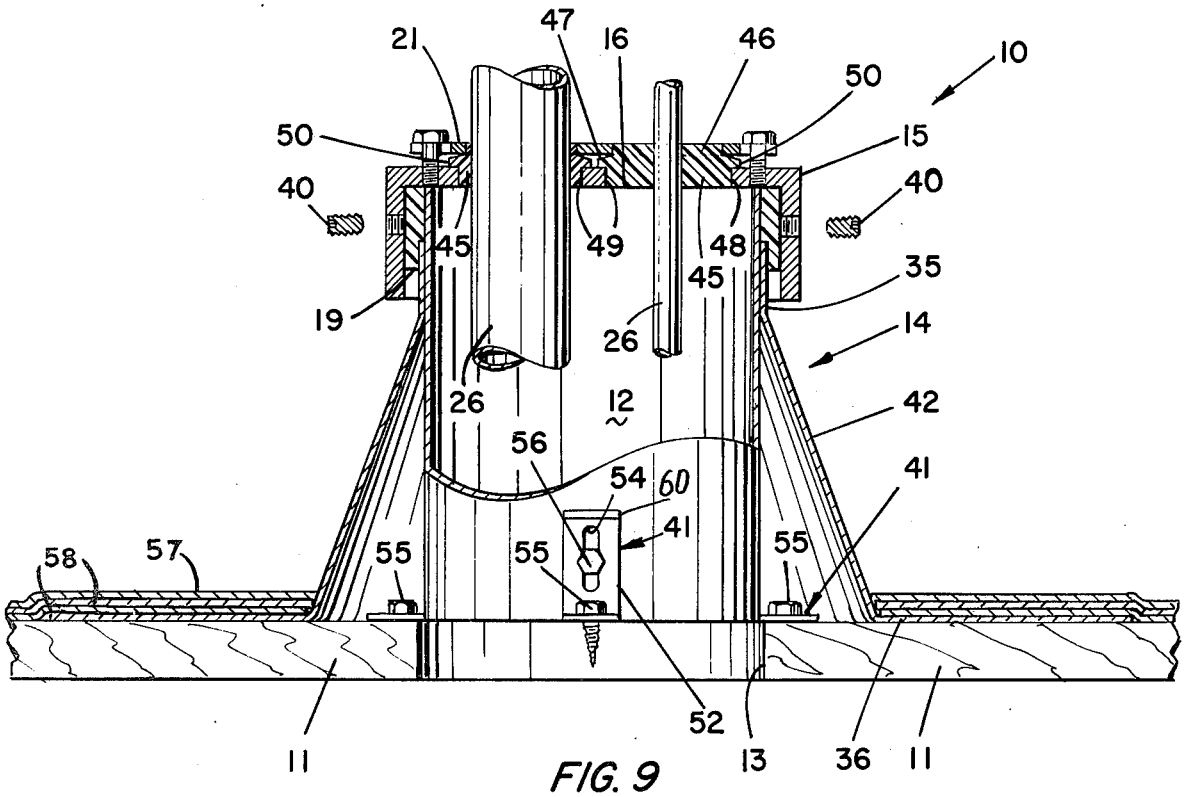
FIG. 9 is a side elevational view, partially in section taken along Plane 10—10 of FIG. 10, of another embodiment of the instant invention.

For example, with particular reference now to FIGS. 9 and 10, another embodiment of the particular invention disclosed herein is shown. The primary differences in this particular embodiment are the addition and use of adjustable legs 41, a cap 15 having an opening 17 with a non-tapered, straight-edged rim, and a roof flashing member 14 which has a conically-shaped base portion 42 in conjunction with the sleeve portion 35 and disposed between the sleeve portion 35 and the flange-like portion 36. Additionally, a retainer clamp 21 has a blanked-out pipe feed-through aperture 43. When an additional pipe or tube 26 is to be added, the plugged portion 44 is merely punched out to open the aperture 43 to allow the use thereof as a pipe or tube feed-through along dotted line 51.

Figure 3:
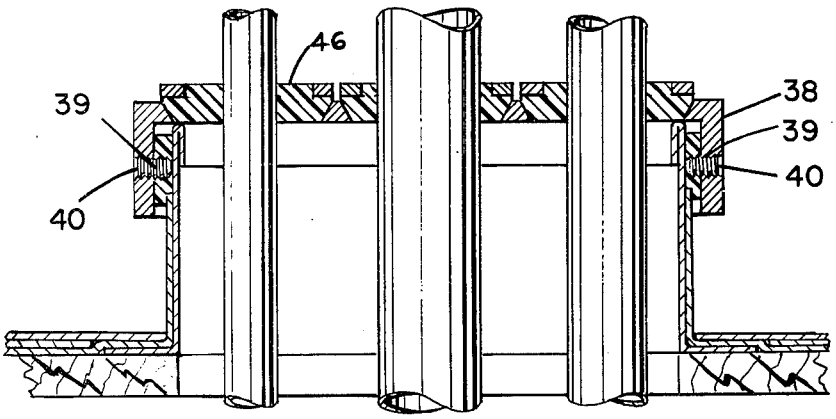
FIG. 3 is a side elevational view of the present invention taken along Plane 3—3 of FIG. 4.
Figure 6:
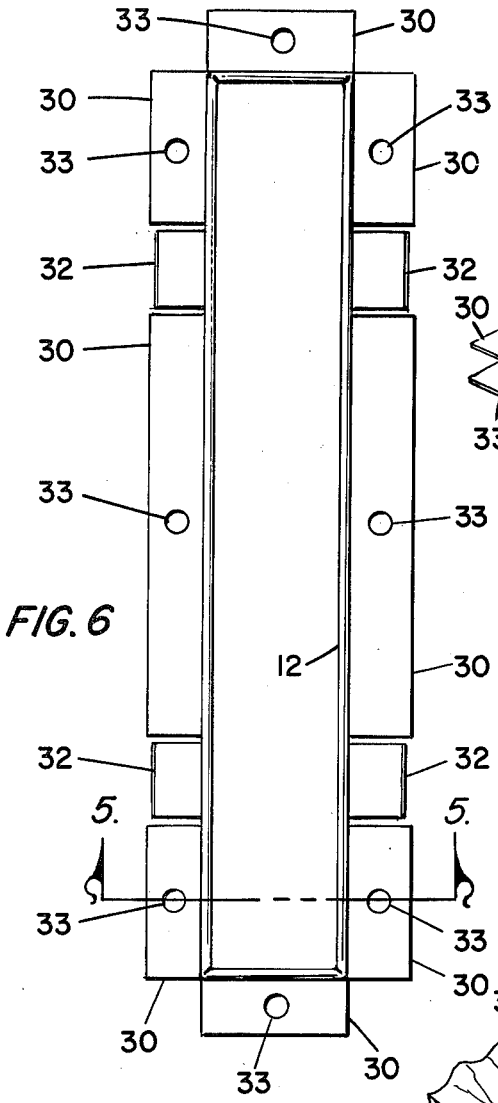
FIG. 6 is a top view of the invention as depicted in FIG. 5.
Figure 7:
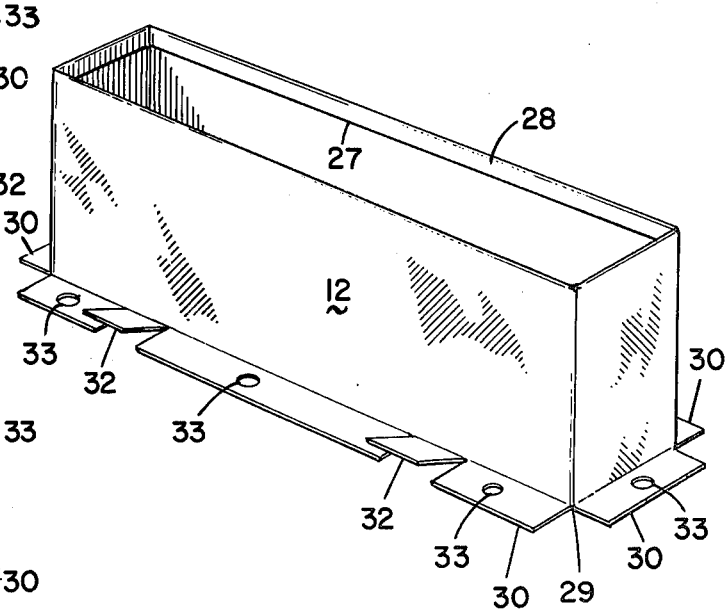
FIG. 7 is a perspective view of the sleeve portion of the invention disclosed herein as illustrated in FIGS. 5 and 6.
Figure 8:
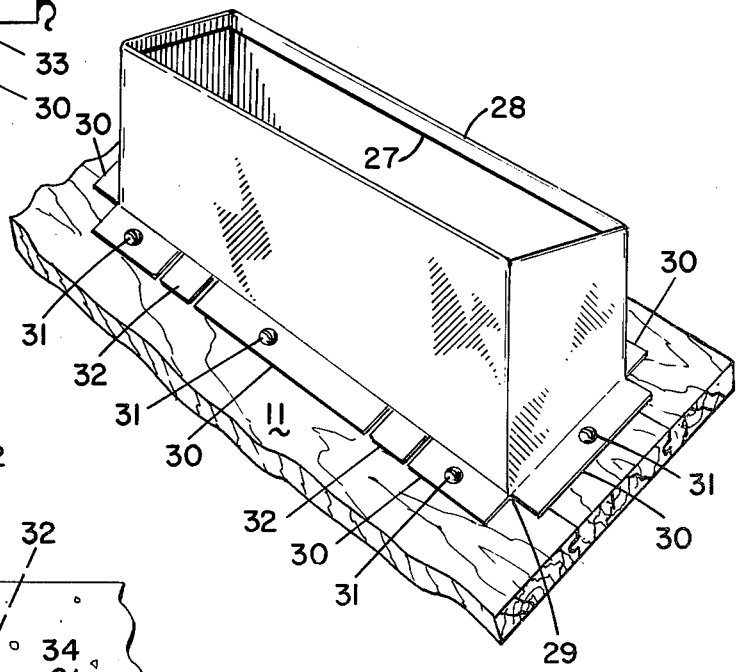
FIG. 8 is a perspective view of the sleeve portion of the invention depicted in FIG. 7 adapted to fit to the slope of a sloping roof.

An alternate form of the double sealing washer 20 is shown in FIG. 9 and is identified by numeral 45. Washer 45 is to be used in conjunction with the non-tapered, straight-edged rim of the opening 49 of the cap 15 of the embodiment in FIG. 9. While the tapered rim of the opening 17 as shown in FIGS. 1 and 3 is inherently self-centering, it is more costly in terms of labor and machining difficulty. This particular washer 45 has a top portion 46 with a beveled portion 47 and a skirt portion 48 with a straight edged, outside diameter which is slideably mateable with the rim of the opening 49. The beveled portion 47 is useful for at least two reasons. One, it allows a portion of the washer 45 to project into the space between the opening 22 of the retainer clamp 21 and the pipe or tube 26 and creates an annular space between the outermost lip 50 of the top portion 46 of the washer 45 and the underside of the retainer clamp 21. The net combined effect of this projection and space is that when the clamp 21 is adjustably moved towards the cap 15, the flexibly resilient material from the which the sealing washer 45 is typically formed, such as Neoprene or other weather-resistant, elastomeric substance, is forced further into the space between the opening 22 and the tube 26 and the annular space between the outermost lip 50 of the top portion 46 of the washer 45 and about the pipe or tube 26, thereby creating a fluid sealing relationship therebetween and about the pipe or tube 26.

The adjustable legs 41 consist of L-shaped brackets 52 having an aperture 53 in the horizontal portion of the bracket 52 and a slotted, elongated aperture 54 in the vertical portion of the bracket 52. A anchoring fastener, such as a lag bolt 55 shown in FIGS. 9 and 10, is passed through the aperture 53 in the horizontal portion of the bracket 52 to adjustably anchor the bracket in fixed relationship to the roof 11. A bolt and nut assembly, the nut not being shown, identified at 56, is passed through the elongated, slotted portion of the vertical portion of the bracket 52 and through a receiving aperture in the wall of the sleeve 12, thereby allowing the sleeve 12 to be adjusted relative to the bracket 52 forming the legs 41, and hence relative to the roof 11.

The adjustable legs 41, of course, permit the height of the sleeve 12 to be varied and to accomodate for a sloping roof line as the legs on the higher portions of the sloping roof 11 would be shorter than the legs secured to the lower sloping roof 11 portion. This permits the sleeve 12 to be utilized in a wider, more diverse, range of roofing installations.

The conically-shaped base portion 42 is preferred in some installations because of its angular relationship relative to rain which falls upon the roof 11. Such a conical base portion 42 allows the rain to run slowly following impact thereon to the cap sheet 57 covering the two felt layers 58 covering the roof 11 rather than allowing the rain to directly impact the roof causing rapid erosion of the roof covering. Also, it permits the opening 13 in the roof 11 to be increased in size without replacing the roof flashing member 14.

It should be clearly noted at this time that the upper or top portions 46 of the washers 20,45, as illustrated and depicted in FIGS. 3 and 9, extended to the upper face of the retainer clamp 21 to ensure that water does not pool on top of the washers 20 and 45.

Once the installation of the present invention is effectuated, the water is effectively precluded from entering into the access opening through the roof 11 even if the water should be standing so that the fluid sealing portion of the assembly is submerged beneath the surface of the standing water.

I claim:

1. An assembly for providing a fluid-sealing passageway for at least one pipe, tube or conduit passed through an opening in the roof of a building, comprising:

(a) sleeve means having a sidewall thereabout and operably disposed about the pipe and having one open end operably alignable with the opening in the roof;

(b) roof flashing means, including a sleeve portion having a rim with an edge thereabout at one end of the sleeve portion and a flanged portion at the other end of the sleeve portion, the sleeve portion being operably disposed about the sleeve means, the length of the sleeve portion being less than the length of the sleeve means;

(c) non-extensible cap means transversely disposed over the other open end of the sleeve means and having at least one aperture therethrough to permit at least one pipe, tube or conduit to be operatively passed therethrough, the cap means further having a skirt depending from the periphery of the transversely disposed portion of the cap means;

(d) first fluid sealing means operably disposed between each pipe, tube or conduit and the cap means about the apertured portion of the cap means;

(e) second fluid sealing means operably disposed between the sidewall adjacent to the rim of the other end of the sleeve means, the sidewall adjacent to the rim of the sleeve portion of the roof flashing means and the skirt of the cap means, and sealingly disposed about the edge of the rim of the sleeve portion of the roof flashing means; and (f) means for retaining the first fluid sealing means between the pipe, tube or conduit and the cap means.

2. The assembly of claim 1, further including anchoring means for securing the sleeve means to the roof about the opening in the roof.

3. The assembly of claim 2 wherein the sleeve means has an outwardly-extending flange portion rimming the open end of the sleeve means about the opening in the roof, the flange portion having a plurality of apertures therethrough to accomodate fastening means for securement to the roof.

4. The assembly of claim 3 further including fastening means operably associated with the apertured portions of the flange portion to secure the flange portion to the roof.

5. The assembly of claim 4 wherein the fastening means are bolts.

6. The assembly of claim 3 wherein the flange portion includes tab means which may be bent towards the sleeve means and away from the roof so that when concrete is poured about the flange portion, anchoring of the sleeve means relative to the roof is substantially improved.

7. The assembly of claim 1 wherein the sleeve means has re-inforced open ends.

8. An assembly for providing a fluid-sealing passageway for at least one pipe, tube or conduit passed through an opening in the roof of a building, comprising:

(a) sleeve means operably disposed about the pipe, tube or conduit and having one open end operably alignable with the opening in the roof;

(b) roof flashing means, including a sleeve portion operably disposed about the sleeve means, wherein the roof flashing means includes a sleeve portion about one open end, the sleeve portion adapted to be matingly disposed about the sleeve means in intimate contiguous relationship therewith;

(c) cap means operably disposed over the other open end of the sleeve means and having at least one aperture therethrough to permit at least one pipe, tube or conduit to be operatively passed therethrough;

(d) first fluid sealing means operably disposed between each pipe, tube or conduit and the cap means about the apertured portion of the cap means;

(e) second fluid sealing means operably disposed between the sleeve means and the cap means; and (f) means for retaining the first fluid sealing means between the pipe, tube or conduit and the cap means.

9. The assembly of claim 8 wherein the sleeve portion of the roof flashing means includes a portion which is conically-shaped and extends outwardly away from the sleeve means.

10. The assembly of claim 9 further including a flange portion about the rim of the conically-shaped portion of the roof flashing means.

11. The assembly of claim 1 wherein the cap means includes a top portion extending over the open end of the sleeve means which extends upwardly away from the roof opening, the top portion having an aperture to permit the passage of a pipe, tube or conduit therethrough, and a skirt portion depending from the top portion and extending over the sleeve portion of the roof flashing means.

12. The assembly of claim 1 wherein the cap means includes a top portion extending over the open end of the sleeve means which extends upwardly away from the roof opening, the top portion having an aperture to permit the passage of a pipe, tube or conduit therethrough, and a skirt portion depending from the top portion and extending over the sleeve portion of the roof flashing means, wherein the skirt portion has a plurality of threaded apertures therein for receiving set screws therein, whereby the set screws may be threadably secured and adjusted to engage the sleeve means for fixedly anchoring thereto.

13. The assembly of claim 11 wherein the aperture through the cap means includes a seat thereabout for receiving the sealing means.

14. The assembly of claim 13 wherein the seat is tapered inwardly to form a smaller diametered portion facing the roof opening.

15. The assembly of claim 14 wherein the first fluid sealing means includes a portion which is conformably mateable with the tapered seat.

16. The assembly of claim 1 wherein the first fluid sealing means is a ring of resilient, elastomeric material.

17. The assembly of claim 16 wherein the material is Neoprene.

18. The assembly of claim 16 wherein the second fluid sealing means is a ring of resilient, elastomeric material.

19. The assembly of claim 18 wherein the second fluid sealing means is formed using a non-hardening waterproof compound.

20. The assembly of claim 1 wherein the means for retaining the fluid sealing means between the pipe, tube or conduit and the cap means is adjustable towards and away from the fluid sealing means.

21. The assembly of claim 20 wherein the means for retaining the fluid sealing means is adjustably secured to the cap means.

22. The assembly of claim 10 further comprising anchoring means for securing the sleeve means to the roof about the opening in the roof, wherein the anchoring means is disposed on the sleeve and including:

(a) a plurality of L-shaped brackets having an aperture in the vertically-arranged member of the L-shaped bracket and an aperture in the horizontally-arranged member;

(b) means for adjustably securing one of the members of the L-shaped bracket to the end of the tubular sleeve arranged about the opening in the roof; and (c) fastening means for anchoring the other of the members of the L-shaped bracket to the roof.

23. The assembly of claim 22 wherein the L-shaped brackets have tab elements adjacent the upper portion thereof which may be bent away from the sleeve so that when concrete is poured about the tab elements, the tab elements prevent withdrawal of the sleeve from the concrete embedment.

24. An assembly for providing a fluid-sealing passageway for a plurality of pipes, tubes or conduits passed through an opening in the roof of a building, comprising:

(a) a tubular sleeve adapted for disposition about the pipes, tubes or conduits and adapted to surround the opening in the roof through which the pipes, tubes or conduits are passed;

(b) means disposed on the tubular sleeve to permit the tubular sleeve to be fastened to the roof;

(c) a roof flashing member including a sleeve portion adapted to be slideably mated about the tubular sleeve and an outwardly-extending flange about one open end thereof adapted to be arranged in intimate relationship to the roof;

(d) a cap having a top portion covering the other open end of the tubular sleeve and extending therebeyond and further having a skirt portion depending therefrom and extending about and below the open end of the sleeve portion of the roof flashing member, the top portion having a plurality of apertures therein for the passage of pipes, tubes or conduits therethrough;

(e) anchoring means for securing the cap to the tubular sleeve;

(f) a first fluid sealing means disposed about each of the plurality of apertures in the top portion of the cap and inbetween each of the pipes, tubes or conduits and the top portion of the cap to provide a fluid seal therebetween;

(g) a retainer clamp having a plurality of apertures therethrough arranged to be operably associated with the apertures in the top portion of the cap for retaining each of the first fluid sealing means in fluid sealing relationship between the respective pipes, tubes or conduits and the top portion of the cap;

(h) fastening means for securing the retainer clamp to the cap; and (i) a second fluid sealing means arranged between the skirt of the cap and the tubular sleeve and the sleeve portion of the roof flashing member to provide a fluid seal therebetween.

25. The assembly of claim 24, wherein the means disposed on the tubular sleeve to permit the tubular sleeve to be fastened to the roof comprises:

(a) a plurality of L-shaped brackets having an aperture in the vertically-arranged member of the L-shaped bracket and an aperture in the horizontally-arranged member;

(b) means for adjustably securing one of the members of the L-shaped bracket to the end of the tubular sleeve arranged about the opening in the roof; and (c) fastening means for anchoring the other of the members of the L-shaped bracket to the roof.

26. The assembly of claim 24 further comprising means associated with the washer to prevent water from standing between the top of the washer and the opening in the retainer clamp.

27. The assembly of claim 1 further comprising means operably associated with the washer to prevent water from standing between the top of the washer and the opening in the retainer clamp.

* * * * *